US005460598A

United States Patent [19]

Yamasaki et al.

[11] Patent Number: 5,460,598

[45] Date of Patent: Oct. 24, 1995

[54] POLYFUNCTIONAL AUTOMATIC MASSAGER OF CHAIR TYPE

[75] Inventors: Yoshikiyo Yamasaki, Sakai; Shinichiro Fujimoto, Osaka, both of Japan

[73] Assignees: Kabushiki Kaisha Japan Health, Sakai; Kabushiki Kaisha Fuji Iryoki, Osaka, both of Japan

[21] Appl. No.: 141,827

[22] Filed: Oct. 22, 1993

[51] Int. Cl.[6] ..... A61H 15/00

[52] U.S. Cl. ..... 601/99; 601/115; 601/98; 601/84

[58] Field of Search ..... 601/51, 52, 84, 601/97–99, 102, 103, 110, 111, 115, 116

[56] References Cited

U.S. PATENT DOCUMENTS

| | | | |
|---|---|---|---|
| 3,800,785 | 4/1974 | Inada | 601/103 |
| 4,009,710 | 3/1977 | Inada | 601/110 X |
| 4,079,732 | 3/1978 | Shinichiro | 601/111 |
| 4,085,738 | 4/1978 | Kodera | 601/103 X |
| 4,149,531 | 4/1979 | Tanaka et al. . | |
| 4,230,098 | 10/1980 | Uematsu | 601/99 |
| 4,574,786 | 3/1986 | Hashimoto et al. . | |
| 4,615,336 | 10/1986 | Fujimoto | 601/102 X |
| 4,686,967 | 8/1987 | Hashimoto et al. . | |
| 4,718,408 | 1/1988 | Barreiro | 601/102 X |
| 5,020,518 | 6/1991 | Spears et al. | 601/116 |
| 5,052,376 | 10/1991 | Yamasaki . | |
| 5,137,016 | 8/1992 | Yamasaki et al. | 601/102 X |
| 5,179,940 | 1/1993 | Barreiro | 601/116 X |
| 5,265,590 | 11/1993 | Takagi | 601/52 |

FOREIGN PATENT DOCUMENTS

| | | | |
|---|---|---|---|
| 5-003899 | 1/1993 | Japan | 601/99 |

*Primary Examiner*—Robert A. Hafer
*Assistant Examiner*—Brian E. Hanlon
*Attorney, Agent, or Firm*—Flynn, Thiel, Boutell & Tanis

[57] ABSTRACT

A chair-type polyfunctional automatic massager which can be used selectively for either a rubbing motion or a finger pressing motion, is driven by one motor and can provide 5 different kinds of movements selectively at will by making the starter apparatus installed in the back of a chair raise and lower. The massager is made up of a driving mechanism which can independently rotate two kinds of driven shafts depending on the direction of rotation of a main spindle rotated by a starter motor. A driven shaft is attached to a rubbing ball mechanism and another driven shaft is attached to a finger pressing mechanism, with both mechanisms linked to a starter device through a connecting mechanism provided between the two mechanisms. A raising and lowering mechanism for the unit is connected with a tapping spindle which can rotate in a forward or reverse direction and is linked to a motor for raising and lowering the unit.

3 Claims, 7 Drawing Sheets

POLYFUNCTIONAL AUTOMATIC MASSAGER OF CHAIR TYPE

BACKGROUND OF THE INVENTION

1. Field of the Invention

This invention is directed to polyfunctional automatic massagers which can perform at least 5 kinds of massaging movement through the action of only 2 kinds of motive power. That is, the massager has a mechanism which can perform two kinds of massaging actions such as a finger pressing movement and a rubbing treatment by one motive power and, at the same time, have a raising and lowering mechanism, which makes possible the above movements to be coupled with a raising and lowering motion provided by another motive power. These mechanisms are installed in a chair as a polyfunctional device, which allows the user to select one of five different actions, ordinary rubbing and finger pressing motions, a rolling, a rolling rub, and a rolling finger pressing motions. Thus, with this invention, it becomes possible for the user to select their favorite massage actions against their body.

2. Description of the Prior Art

Previous automatic massagers were common in their actions of rubbing and rapping against the user's body by a pair of rubbing balls of an electric massage mechanism installed inside the back of a chair.

In the chair-type automatic massagers of the previously invented massagers, some had a motor-driven mechanism for raising and lowering of a rubbing ball mechanism by rotating a tapping spindle installed vertically in the back of a chair in a forward or reverse direction. The users were able to receive a massage by rubbing and rapping motions against all areas of their backs using the massage mechanism having the raising and lowering mechanism.

In recent years, in place of the above-mentioned rubbing and rapping movements, other functions such as rolling and finger pressing motions have been demanded as functions of massagers. Therefore, in order to satisfy the need for rolling and finger pressing movements, massagers which are able to do, in addition to rubbing and rapping actions, a rolling movement with turning rollers around the human back area and along the spinal cord by setting a pair of free turning rollers bilaterally, in place of a pair of rubbing balls which could perform only rubbing and rapping motions, and by making these rollers move up and down, have been developed.

It has been found that, for the above-mentioned massagers having an additional finger pressing movement, it is possible to develop massagers having polyfunctional movements such as rolling and finger pressing ones, in addition to rubbing and rapping movements, by setting up a separate motor for the finger o pressing action in addition to a motor for rubbing and rapping motions.

However, although a massager having free turning bilateral rollers installed inside the back of a chair, in place of the rubbing balls for rubbing and rapping motions, having rollers which move continuously up and down, has been developed, although it could provide a rolling motion, it could not provide any finger pressing treatment. Therefore, in order to obtain a massager with polyfunctional movements by improving the above massager, it is necessary to install an additional motor inside the back of the chair. However, it is practically impossible to add functionality by increasing the number of motors because the back of a chair becomes too heavy to stand without falling backward, especially when the back of the chair is in an oblique position. Hence, it is dangerous to make such a chair.

While considering the above-mentioned situation, many studies intending on obtaining polyfunctional automatic massagers without increasing the number of motors having been performed, but the development of such massagers satisfying the user's request, which are driven by one motor to give a finger pressing and a rapping motion in combination with a massaging motion which moves up and down vertically along the back of a chair, have been unsuccessful.

SUMMARY OF THE INVENTION

This invention successfully develops a starter device which makes it possible to do both finger pressing and rubbing movements with one motive power and has been accomplished with the object of presenting chair-type polyfunctional automatic massagers which are able to perform at least 5 kinds of different movements using only two different motive powers for a starter device and raising and lowering by installing them inside the back of a chair. The starter device can be moved vertically along the back of a chair by the second motive power. Therefore, users may select the movements according to their preferences.

The polyfunctional chair-type automatic massagers of this invention allows the user to select more than 5 kinds of movements through the operation of a polyfunctional device, which is furnished, in order to accomplish the above purpose, inside the back of an automatic massage chair. This polyfunctional device is constructed by connecting a starter device with a gear to a tapping spindle, which can be rotated in a forward or reverse direction by the work of a motor for raising and lowering. Two kinds of driven shafts are independently rotated in a forward and reverse direction by a main spindle interlocked to the starter motor and one of the driven shafts is connected to a rubbing ball mechanism and the other is connected to a finger pressing mechanism, and both mechanisms are connected to each other through a connecting mechanism fixed between them.

The polyfunctional automatic massager of this invention is characterized by its construction for preventing a twisting and tearing of the cover cloth of the chair, which is caused by the contact of a rubbing and a finger pressing device with the inner surface of the cloth at the time of raising and lowering of these devices, by arranging turning rollers and finger pressing rollers as described below. The rubbing ball mechanism has a pair of turning rollers which work in cooperation with both ends of the first driven shaft of a drive mechanism and the finger pressing mechanism also has a pair of finger pressing rollers connected to both ends of the second driven shaft of the driving mechanism, and a connecting mechanism is provided between these rollers. A starter device, which attains a suitable movement in a transverse direction of a pair of finger pressing rollers and a suitable back and forth movement of the finger pressing rollers by alternate rotation in a forward and reverse direction of the starter motor, respectively, is geared with a tapping spindle of a raising and lowering mechanism.

Thus, the polyfunctional chair-type automatic massager is able to give superior actions as follows when it is constructed as mentioned above.

The mechanism of the automatic massager of this invention is made up of the rubbing ball mechanism and the finger pressing mechanism, which have a pair of turning rollers and a pair of finger pressing rollers, respectively, separately at both ends of each driven shaft. These two kinds of driven shafts can be rotated independently according to a forward or reverse direction of a main spindle, which is rotated in connection with a starter motor.

When the starter motor is rotated in the forward direction, only one of the driven shafts can rotate to give a rubbing action with a pair of the turning rollers, and when the starter motor is rotated in the reverse direction, the other driven shaft can rotate to give a finger pressing action by making frequent appearance of a pair of the finger pressing rollers, and further when a motor for raising and lowering is started, a rolling action under continuous up and down movement can be done in relation to the up and down movement of the starter device. That is, either a rolling rubbing action or a rolling finger pressing action under continuous raising and lowering is attained by either the forward or reverse rotation of the starter motor after turning on the switch of the motor for raising and lowering. Therefore, users can select at will one of the five different kinds of massage actions by setting the direction of the rotation of the starter motor and by turning on or off the switch of the motor for raising and lowering.

Since a pair of the turning rollers are used for the rubbing ball mechanism and a pair of the finger pressing rollers are used for the finger pressing mechanism, the contact of the cloth backing covering the back of a chair having both the rubbing ball mechanism and the finger pressing mechanism at the time of the raising and lowering of the starter device by the motor for raising and lowering is done through the turning rollers and through the finger pressing rollers. Hence, the polyfunctional automatic massager of this invention is constructed so as to prevent problems from arising from either the stretching and twisting or the breaching of the cover cloth on the back of the chair.

DETAILED DESCRIPTION OF THE INVENTION

Figure 1:
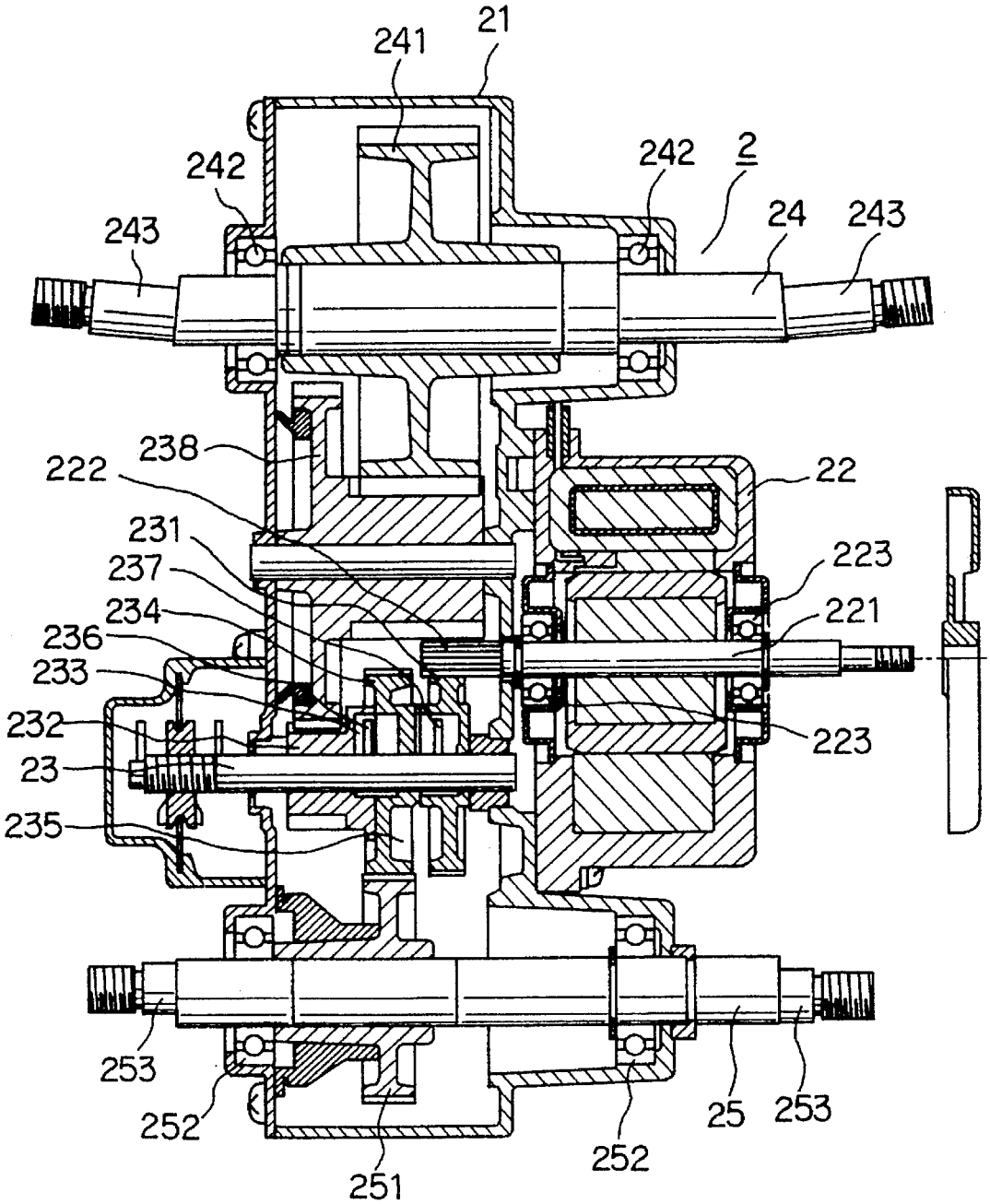
FIG. 1 is a cross sectional drawing of a driving mechanism of the polyfunctional chair-type automatic massager showing an embodiment of this invention.
Figure 2:
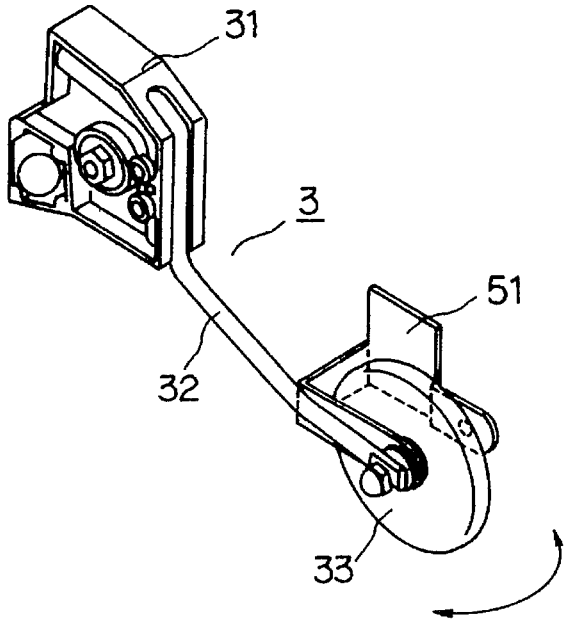
FIG. 2 is an explanatory drawing of a rubbing device showing an embodiment of this invention.
Figure 3:
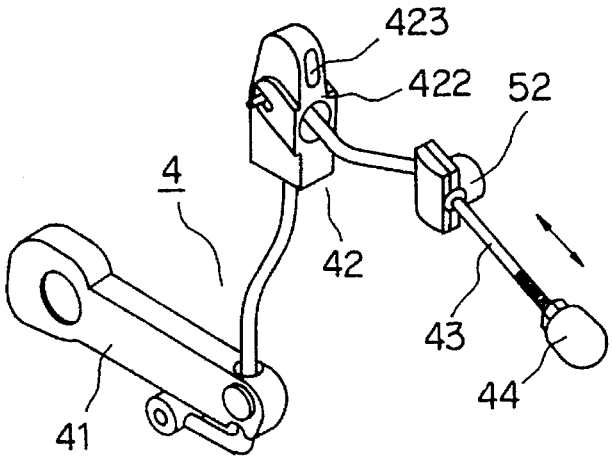
FIG. 3 is an explanatory drawing of a finger pressing device showing an embodiment of this invention.
Figure 4:
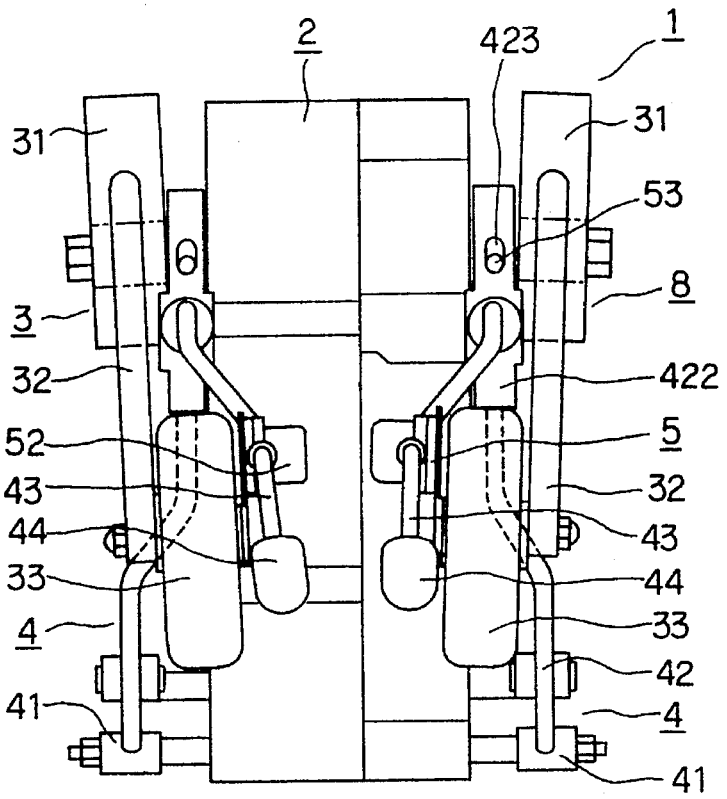
FIG. 4 is an explanatory drawing of a starter device showing an embodiment of this invention.
Figure 5:
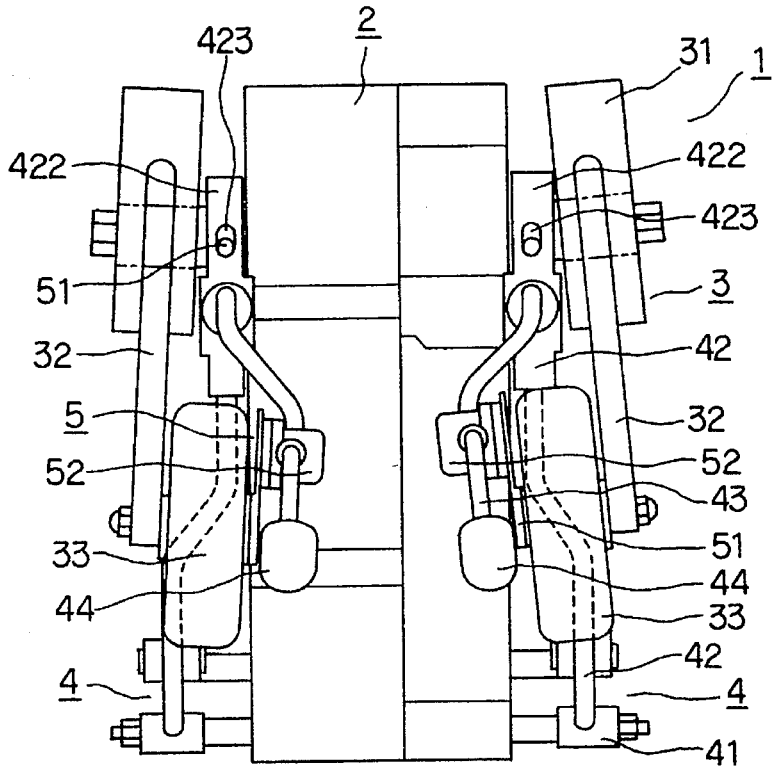
FIG. 5 is an explanatory drawing of a starter device showing an embodiment of this invention.
Figure 6:
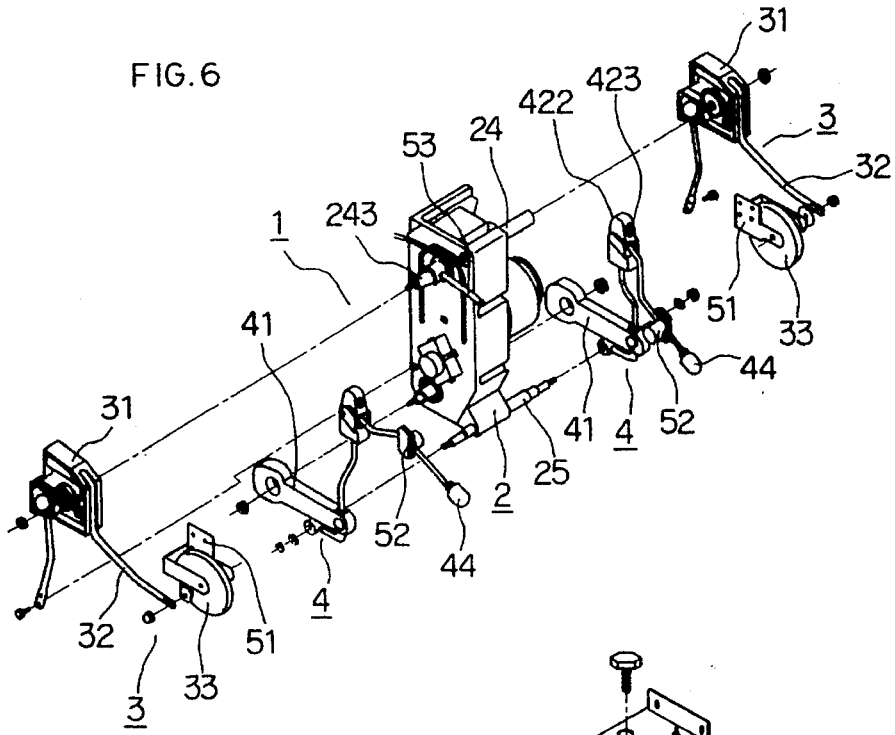
FIG. 6 is an exploded drawing of a starter device showing an embodiment of this invention.
Figure 7:
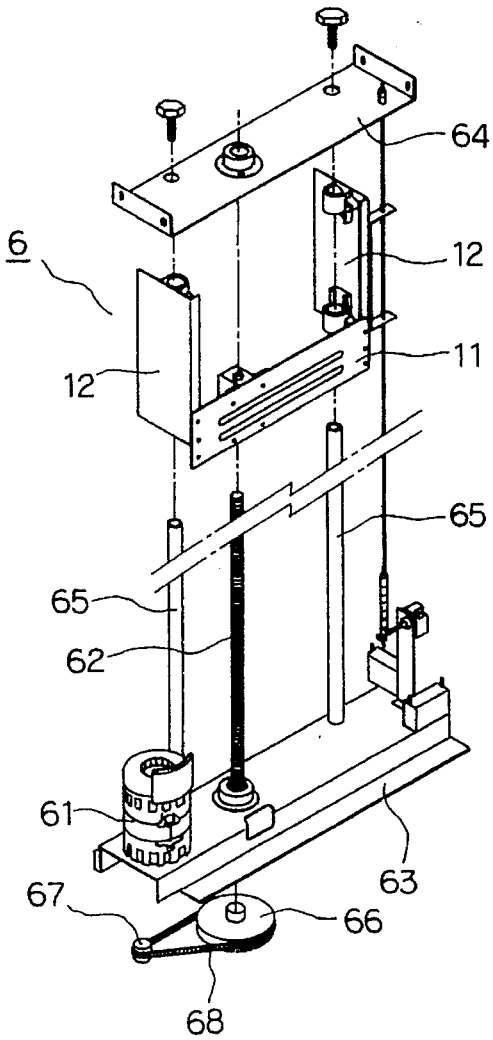
FIG. 7 is an exploded drawing of a raising and lowering mechanism showing an embodiment of this invention.
Figure 8:
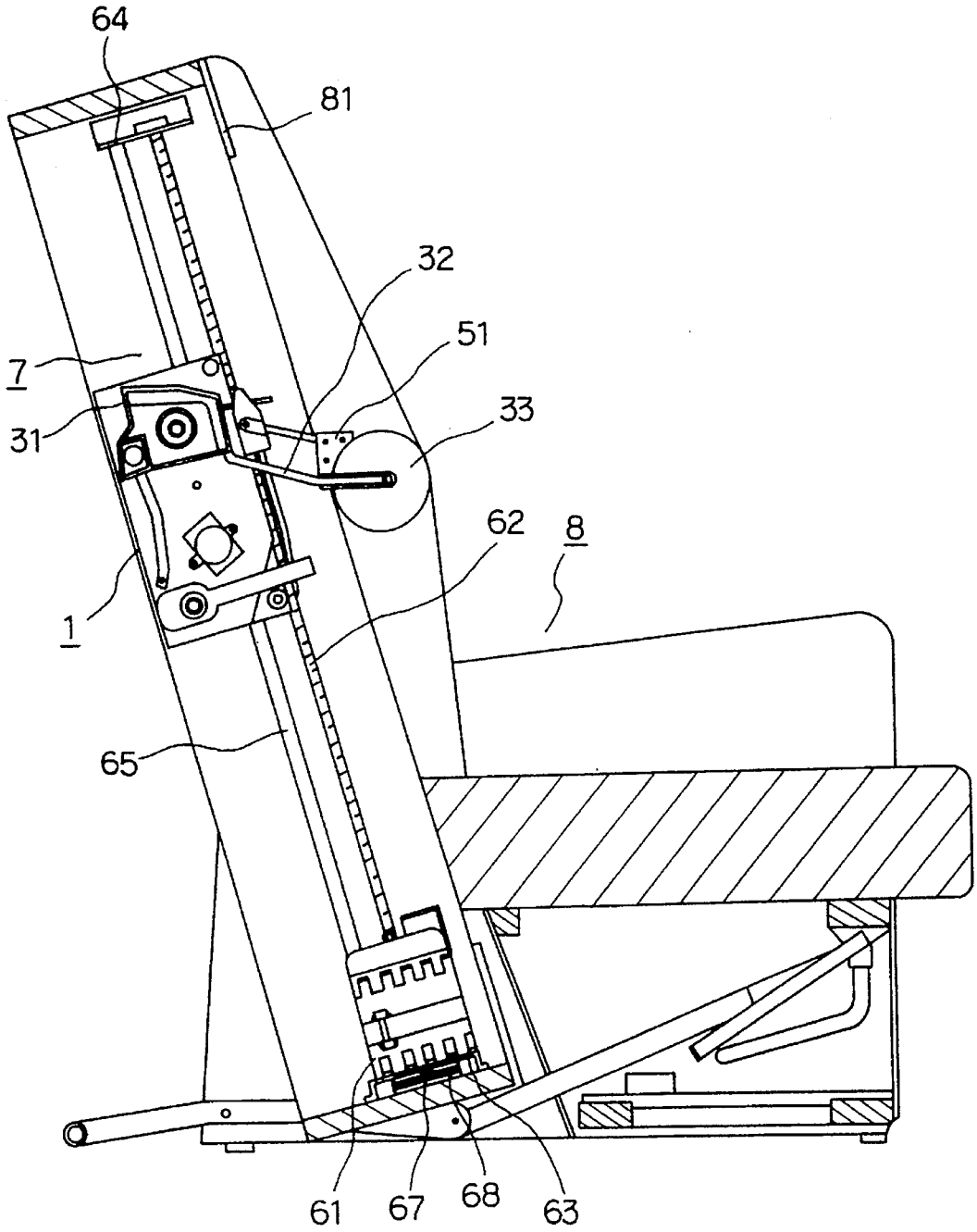
FIG. 8 is an explanatory drawing of a polyfunctional chair-type automatic massager showing an embodiment of this invention.
Figure 9:
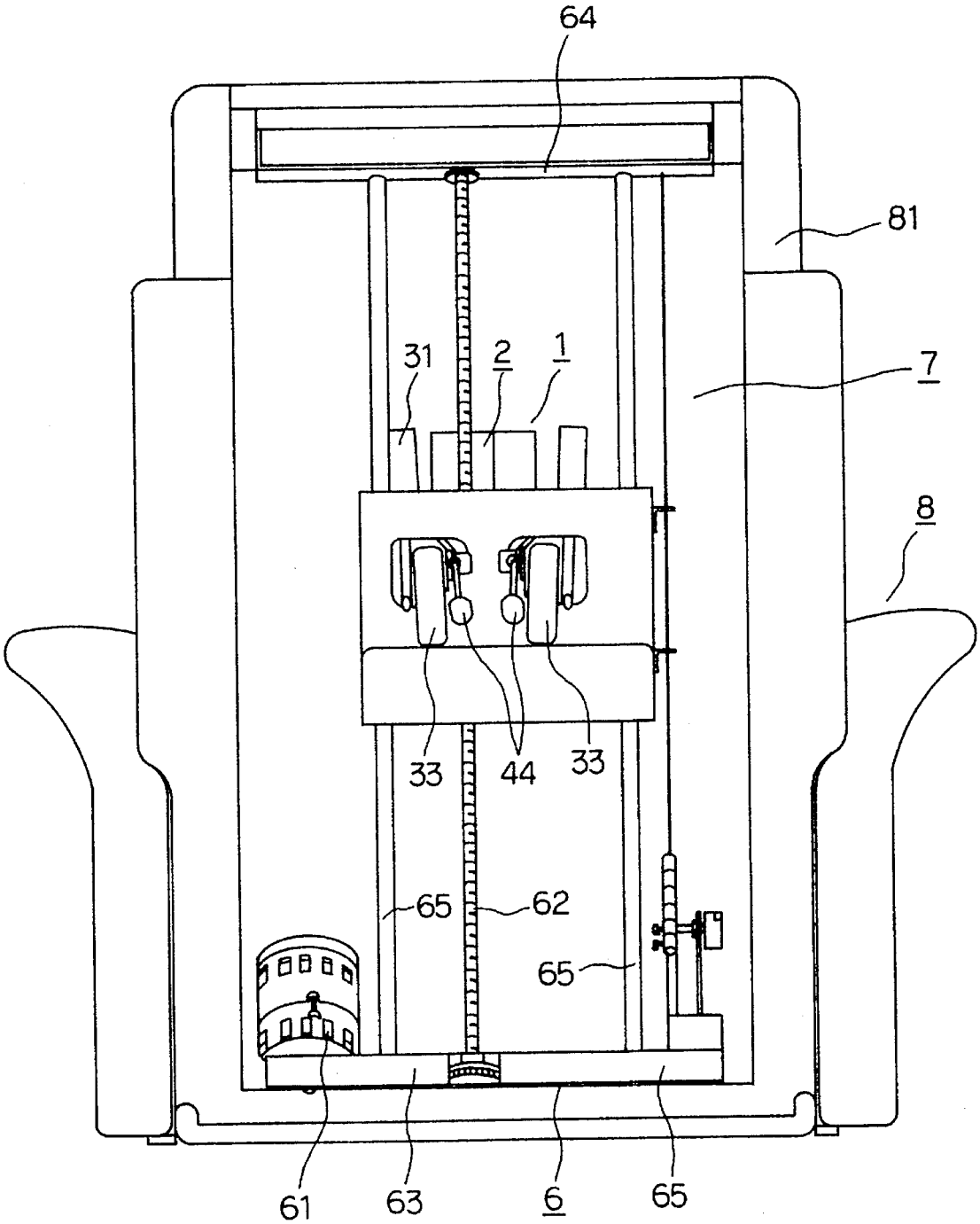
FIG. 9 is an explanatory drawing of a polyfunctional chair-type automatic massager showing an embodiment of this invention.
Figure 10:
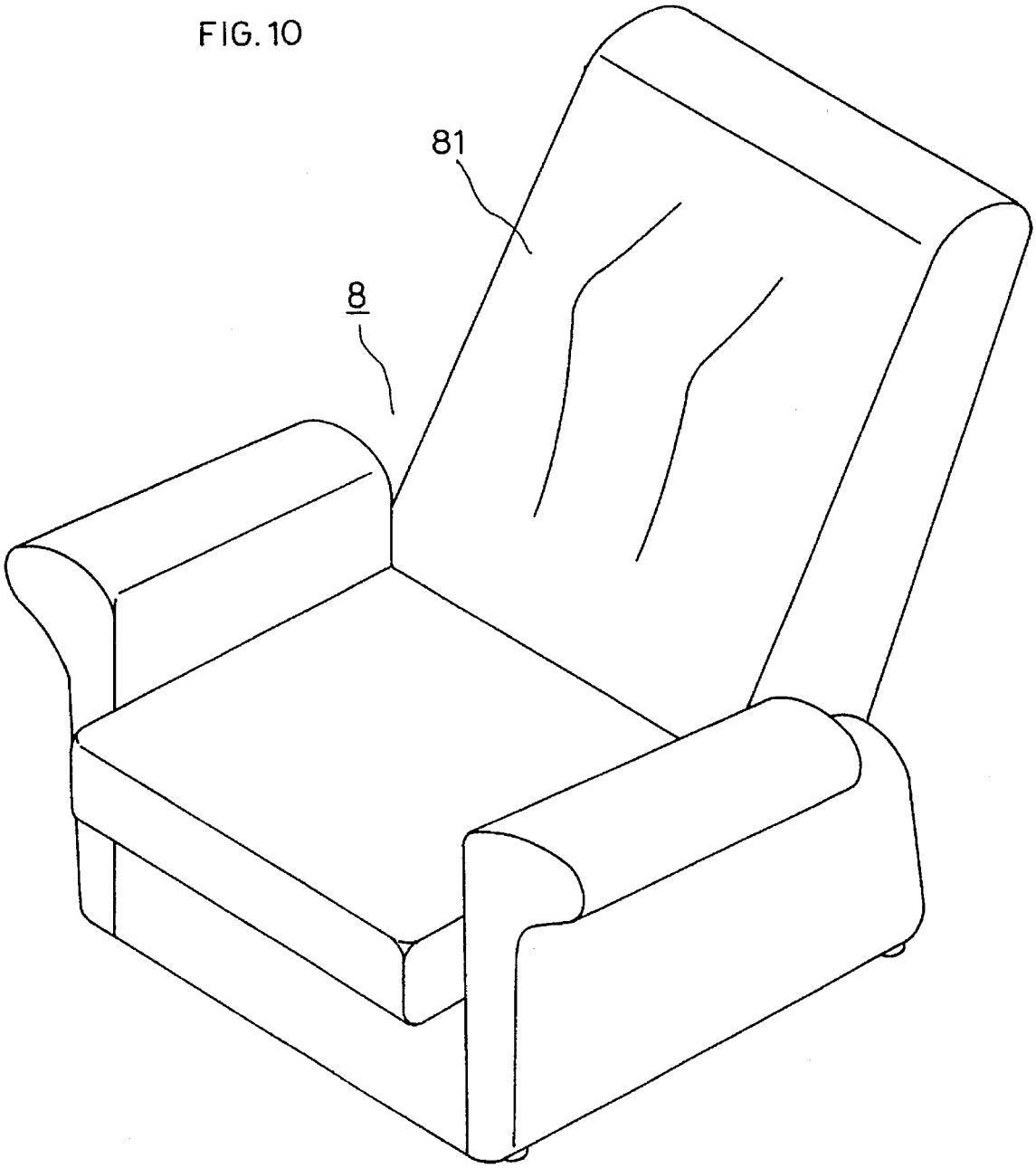
FIG. 10 is a drawing of a perspective view of a chair-type polyfunctional automatic massager showing an embodiment of this invention.

An embodiment of a driving mechanism used in the polyfunctional chair-type automatic massager is shown in FIG. 1, a rubbing ball mechanism used for the massager of this invention in FIG. 2, a finger pressing mechanism used for the massager of this invention in FIG. 3, and a starter device used for the massager of this invention is shown in FIGS. 4–6. An embodiment of a raising and lowering mechanism of this invention is shown in FIG. 7 and that of a polyfunctional automatic massager of this invention is shown in FIGS. 8–10.

The polyfunctional automatic massager is formed by the installation of a polyfunctional device 7 inside the back 81 of a chair itself. The polyfunctional device 7 is made up of the raising and lowering mechanism 6, which has a tapping spindle 62, which rotates in either a forward or reverse direction, linked to a motor 61 for raising and lowering the massaging unit, and a starter device 1, which is composed of a rubbing ball mechanism 3 connected to a driven shaft 24 of a driving mechanism 2 and a finger pressing mechanism 4 connected to another driven shaft 25. The rubbing ball mechanism 3 and the finger pressing mechanism 4 are connected through a connecting mechanism 5 between them. Each of the driven shafts 24 and 25 is rotated independently in relation to the forward or reverse rotation of a main spindle 23 linked to a starter motor 22.

The above-mentioned driving mechanism 2 is constructed as shown in FIG. 1, in which either the forward or reverse rotation of the main spindle 23 rotating in a gear box 21 and driven by the rotation of the starter motor 22 can be transferred to two kinds of planetary gears 232 and 234 to rotate them independently, which are transmitted to the different driven shafts 24 and 25, respectively, to give them independent rotations.

The starter motor 22 described above can rotate a main spindle gear 231 of the main spindle 23 intermeshed with a gear tooth 222, in which both ends of a starter motor shaft 221, with the gear tooth 222 being at one end, are supported by bearings 223.

Two kinds of planetary gears 232 and 234, having barrel-shaped flutes 233 and 235 at the center, are rigidly fixed at the main spindle parallel to the main spindle gear 231 so as to confront the flutes 233 and 235 each other and driven shaft pins 236 fixed into each flute 233 and 235 and main spindle pins 237 fixed into the main spindle gear 231 extend radially outward around the said main spindle 23.

Thus, when the main spindle 23 is rotated, the driving power is transferred to either the first driven shaft 24 or the second driven shaft 25 of the driving mechanism 2.

The first driven shaft 24 is driven by the first driven gear 241 through a turning gear 238 engaged with the planetary gear 232 and is supported at both ends by bearings 242 and rotates smoothly during the transmission of the rotation of the main spindle 23 and further makes a pair of the turning rollers 33 of the rubbing ball mechanism 3 swing in a transverse direction according to both ends of the shaft 24 which have an eccentric bend 243 and to which the rubbing mechanism 3 is connected.

The second driven shaft 25 is driven by the second driven shaft gear 251 meshed with the planetary gear 234 of the main spindle 23 and is supported at both ends by bearings 252 and rotates smoothly during the transmission of the rotation of the main spindle 23 and further makes a pair of the finger pressing rollers 44 appear at a frequency determined by a length corresponding to that from the center of the shaft to the eccentric center alternately attained by a mechanism having both ends of the shaft 25 processed symmetrically to have an eccentric bend 253 to which the finger pressing mechanism 4 is connected.

The rubbing ball mechanism 3 is designed to make a pair of turning rollers 33 swing constantly toward the right and the left and is constructed, as shown in FIG. 2, from the supporting materials 31 for rubbing balls, which can be fixed to or detached from the folding positions 243 and 243 at both ends of the first driven shaft 24 of the driving mechanism 2, a supporting rod 32 for rubbing balls, which is attached by inserting its end into the supporting materials 31 for rubbing balls, and the turning rollers 33, which are fixed rotatively to a pointed end of each supporting rod for the rubbing balls 32. The rubbing ball mechanism 3 also makes the supporting material 31 of the bend at the ends of the first driven shaft 24 swing eccentrically and further makes each of the turning rollers 33 at the pointed ends of a pair of the supporting rods 32·32 for rubbing balls swing toward the right and the left.

A supporting plate 51 for the connecting mechanism 5 is attached so as to be able to move together at the starting position of the turning roller 33 at the supporting rods 32 for the rubbing balls, the right and left movements of a pair of the turning rollers 33 and the raising and lowering swings, such as the back and forth movement of a pair of the finger pressing rollers 44, caused by the forward or reverse rotation of the starter motor 22, are made possible as described below.

The finger pressing mechanism 4 described above allows the frequent appearance of a pair of finger pressing rollers 44 at right and left positions of the mechanism and is constructed from supporting materials 41 for finger pressing balls and fixed to the eccentrically bent shafts 253·253 at both ends of the second driven shaft 25 of the driving mechanism 2, a connector 42, fixed to each pointed end of the supporting material 41 through a connecting rod 421, so as to extend upwardly outward, and a slide bar 43 fixed upon each of the connecting materials 42 so as to extend forward, and finger pressing rollers 44, fixed upon the pointed ends of the slide bars 43 as shown in FIG. 3. The mechanism 4 makes the supporting material 41 for the finger pressing ball frequently appear backward and forward and hence makes possible each of the finger pressing rollers 44 at the pointed ends of a pair of the slide bars 43·43 appear frequently and alternately by the length of eccentricity in the eccentrically bent shaft 253 at both ends of the second driven shaft 25.

In FIG. 3, 422 is a supporting material for the slide bar of the connecting material 42, and at an upper position of the fixed position of the slide bar 43 on the supporting material 422 for the slide bar, a guide hole 423 for the slide bar is provided to guide the supporting material 422 firmly along a guide bar 53 for sliding motion set up so as to extend forwardly from each of the sides of the first driven shaft 24.

A supporting material 52 for sliding motion fixed as a monoblock on the supporting plate 51 for the connecting mechanism 5 at the middle point of the slide bar 43 is provided to work smoothly with the plate by inserting the slide bar 43, which is guided stably along the supporting material 52 for sliding motion, by the reverse rotation of the starter motor 22. Thus, a pair of the finger pressing rollers 44 are able to make frequent appearances both forward and backward.

The connecting mechanism 5 works together with both the rubbing ball mechanism 3 and the finger pressing mechanism 4 to give the turning roller 33 a suitable swing towards the right and the left and makes a pair of the finger pressing rollers 44 appear frequently, as shown in FIG. 2 –FIG. 6, and is constructed from the supporting plate 51, attached to the starting position of the turning roller 33 at the supporting materials 32 for the rubbing balls in the rubbing ball mechanism 3, the supporting materials 52 for sliding motion, fixed to each of the supporting plates 51 and inserted around the middle point of each slide bar 43 in the supporting mechanism 4 for the slide bar, and the guide bar 53 for sliding motion, is provided so as to penetrate the guide hole 423 for the slide bar of the supporting material 422 for the slide bar in extending out forwardly from both ends of the primary driven shaft 24. Thus, the swing toward the right and the left of a pair of the turning rollers 33 and the frequent appearance in the back and forth directions of a pair of the finger pressing rollers 44 driven by the forward and reverse rotations of the starter motor 22 occur suitably and smoothly.

The raising and lowering mechanism 6 works to smoothly raise and lower the starter device 1, installed inside the back 81 of a chair itself 8, and, as shown in FIGS. 7–9, has a base plate 63 and a top plate 64, between which a pair of supporting rods 65·65 are fixed inside the back 81 in vertically parallel relationship, and between these rods (65, 65) a tapping spindle 62 rotatable in a forward or reverse direction and linked to a motor 61 for raising and lowering the massaging unit is set parallel to them and the tapping spindle 62 is geared to the starter device 1, which makes it possible to raise and lower the massaging unit inside the back of the chair. 66 is a pulley provided at a lower part of the tapping spindle 62 and is joined by way of a V-belt 68 to a pulley 67 connected to the motor 61 for raising and lowering. Therefore, the rotation of the motor for raising and lowering the unit is transmitted to the tapping spindle 62. The polyfunctional device 7 is constructed by engaging with the starter device 1 which is meshed with the tapping spindle 62 of the raising and lowering mechanism 6. At the same time, by making both ends of the starter device support each of the supporting rods 65·65, the gearing of the starter device 1 to the tapping spindle 62 of the raising and lowering mechanism 6 is supported firmly by the supporting plates 11 for the starter device geared with the tapping spindle 62 as shown in FIG. 7 and is held by a pair of supporting plates 12·12 for the starter device and geared with each other firmly.

EMBODIMENT

When the polyfunctional chair-type automatic massager of this invention is used, either a rubbing motion with the turning rollers 33 or a finger pressing motion with the finger pressing rollers 44 can be selected easily by rotating the starter motor 22 in the said starter device 1 in the forward or reverse direction, respectively and, further, the starter device can be continuously raised and lowered by driving the motor 61 for raising and lowering in the raising and lowering mechanism 6.

For example, in the case of selecting a rubbing motion at a fixed position of the body, the user drives the starter motor 22 in the forward direction, then the rotation is transmitted to the main spindle 23 through the gear tooth 222 and the main spindle gear 231, and this main spindle 23 moves toward the axle direction to come into contact with the driven pin 236, which has moved to the flute 233 in the planetary gear 234, to which the first driven gear 241 interlocks through the engaging of the revolving gear 238 and the planetary gear 232 to give a rotation to the first driven shaft 24.

This rotation makes the rubbing ball mechanism 3, on both sides, operate to achieve a rubbing motion by rotating a pair of turning rollers 33 as shown in FIG. 5.

When the user selects a finger pressing motion from the massager of this invention, the starter motor 22 is driven in the reverse direction, which is transmitted to the main spindle 23 through the gear tooth 222 and the driving gear 231. The main spindle 23 then moves toward the axle direction to come into contact with the driven pin 236, which has moved to the flute 235 in the planetary gear 234, to which the second driven gear 251 and the planetary gear 232 interlocks to give a rotation to the second driven shaft 25.

This rotation makes both sides of the finger pressing mechanism 4 operate to achieve a finger pressing motion by rotating a pair of the finger pressing rollers 44 as shown in FIG. 4.

Further, when the user selects a rolling motion from the massager of this invention, the motor for raising and lowering the unit 61 is driven in the raising and lowering mechanism 6. The starter device 1 then continuously raises and lowers through the rotation of the tapping spindle 62 working together with the motor 61 for raising and lowering. Thus, a rolling movement by a pair of the turning rollers 33 may operate.

Further, when the user selects a rolling rubbing motion from the massager of this invention, the motor 61 for raising and lowering is driven in the raising and lowering mechanism 6 and, at the same time, the starter motor 22 is driven in the forward direction. The continuous raising and lowering (rolling) of the starting device 1 through the rotation of the tapping spindle 62 linked to the motor 61 for raising and lowering and simultaneous rubbing motion by a pair of the turning rollers 33 of the rubbing ball mechanism 3 in the starter device 1 may be achieved. Therefore, a rolling rubbing motion by a pair of the turning rollers 33 may be obtained.

Moreover, when the user selects a rolling finger pressing motion from the massager of this invention, the motor 61 for raising and lowering is driven in the raising and lowering mechanism 6 and, at the same time, the starter motor 22 is driven in the reverse direction. Then, a continuous raising and lowering (rolling) of the starter device 1 through the rotation of the tapping spindle 62 linked to the motor 61 for raising and lowering and, simultaneously, a finger pressing motion by a pair of the finger pressing rollers 44 of the finger pressing mechanism 4 in the starter device 1 may be achieved. Therefore, a rolling finger pressing motion by a pair of the finger pressing rollers 44 may be obtained.

The polyfunctional chair-type automatic massager of this invention is constructed so as to enable the user to select one of 5 kinds of massage modes through the installation of the polyfunctional device inside the back of a chair itself. Thus, the user can independently select either the rubbing ball mechanism or the finger pressing mechanism, both being linked to a drive mechanism by one motive power and, further, the user can make these mechanisms continuously raise and lower by another motive power. This is based on a novel idea different from one based on a secondary conception such as the simple idea of adding a motor(s) to the previously invented automatic massager in order to give another function(s). Thus, the automatic massagers of this invention have successfully achieved polyfunctionality without an increase in its weight. Therefore, there is no risk of falling backward due to the heaviness of the back of a chair, even if it is used with the back of the chair in an inclined position and can be used under safer conditions.

Especially during the operation of the finger pressing mechanism, the massage mechanism of this invention can be adjusted by changing the design of the driving mechanism according to each user because the contact interval of the planetary gears with the second driven shaft gear can be changed freely and, by doing this, the frequency of the appearance of the finger pressing roller in the finger pressing mechanism can be determined optionally.

Problems arising from stretching and twisting or breaching of the cover cloth for the back of a chair have been eliminated by changing the working balls used for the rubbing ball mechanism and the finger pressing mechanism for the turning rollers and finger pressing rollers, respectively. Thus, the rollers can move smoothly inside the back of a chair, even if the rollers should raise and lower frequently. As this invention eliminates unsolved problems associated with previous massagers and satisfies several requirements in terms of improvement, the polyfunctional chair-type automatic massager of this invention is an epoch-making one of excellence with respect to novelty, compactness, polyfunctionality, safety, and durability.

What is claimed is:

1. A polyfunctional chair-type automatic massager comprising a chair having a chair back and a massaging unit installed inside said chair back, said massager comprising a first mechanism for providing a rolling massage and a second mechanism for providing a finger pressure massage, said first mechanism comprising a first driven shaft drivingly connected to a supporting rod having a turning roller provided at an end thereof, said second mechanism comprising a second driven shaft drivingly connected to a slide bar having a finger pressure roller provided at an end thereof, a raising and lowering mechanism provided at a lower portion of the chair back for raising and lowering the massaging unit along the length of the chair back, said raising and lowering mechanism comprising a motor and a rotatable spindle driven by said motor, said spindle rotating in a first direction to raise said massaging unit and rotating in a second direction opposite to said first direction to lower said massaging unit, and a starter motor for driving said first and second driven shafts, said first and second driven shafts being capable of independent motion and being coupled to each other through a connection mechanism, said turning roller moving in a reciprocating side-to-side motion when said starter motor is driven in a forward direction and said finger pressure roller moving reciprocatingly to and from said massager when said starter motor is driven in a reverse direction.

2. The massager of claim 1, wherein a main spindle is driven by said starter motor, said main spindle being rotatable in a first direction and a second direction opposite to said first direction, the rotation of said main spindle capable of driving two planetary gears independent of each other, one of said planetary gears driving said first driving shaft and the other of said planetary gears driving said second driving shaft.

3. The massager of claim 1, wherein said connecting mechanism comprises a supporting plate associatd with the first mechanism and a sliding support associated with the second mechanism.

* * * * *

UNITED STATES PATENT AND TRADEMARK OFFICE

CERTIFICATE OF CORRECTION

PATENT NO. : 5,460,598

DATED : October 24, 1995

INVENTOR(S) : Yoshikiyo Yamasaki, et. al.

It is certified that error appears in the above-indentified patent and that said Letters Patent is hereby corrected as shown below:

Column 8, line 43; change "connection mechanism" to ---connecting mechanism---.

Column 8, line 58; change "associatd" to ---associated---.

Signed and Sealed this

Fourth Day of June, 1996

Bruce Lehman

*Attest:*

BRUCE LEHMAN

*Attesting Officer*

*Commissioner of Patents and Trademarks*